United States Patent [19]

Lehmann

[11] 4,339,146

[45] Jul. 13, 1982

[54] COACHWORK FOR A MEDICALLY EQUIPPED VEHICLE

[75] Inventor: J. C. Ludwig Lehmann, Lorch, Fed. Rep. of Germany

[73] Assignee: Binz GmbH & Co., Lorch, Fed. Rep. of Germany

[21] Appl. No.: 182,323

[22] Filed: Aug. 28, 1980

[30] Foreign Application Priority Data

Sep. 12, 1979 [DE] Fed. Rep. of Germany ..... 2936858
Feb. 1, 1980 [DE] Fed. Rep. of Germany ..... 3003687

[51] Int. Cl.[3] ..... A61G 3/00
[52] U.S. Cl. ..... 296/19; 244/118.6
[58] Field of Search ..... 296/19, 20, 156, 168, 296/172, 173, 176, 26, 27; 244/118.5, 118.6

[56] References Cited

U.S. PATENT DOCUMENTS 4,154,237 5/1979 Courter ..... 244/118.6
4,273,374 6/1981 Portman ..... 296/19

*Primary Examiner*—Joseph F. Peters, Jr.
*Assistant Examiner*—John A. Carroll
*Attorney, Agent, or Firm*—Michael J. Striker

[57] ABSTRACT

A medically equipped vehicle has a cabin adapted to accommodate medical apparatus such as infusion flasks and respirators. These items of medical apparatus are located in containers 11, 12 which are pivotally fastened at 13 to a ceiling or associated part of the cabin. When not in use the apparatus can thus be stowed in an enclosed space defined between the container and the ceiling. The container can be pivoted downwardly to a hanging position in which the enclosed apparatus is readily accessible. To keep blood plasma and the like at the required temperature a heating device 41 or, a heat exchanger which can be used both for cooling and heating purposes, is incorporated in the container. The container is usefully of thermally insulated construction. Cables and lines necessary for the respirators and for infusion purposes are conveniently connected to the associated apparatus ready for use. Connections to auxiliary apparatus such, as oxygen bottles are conveniently made by ducting the connection lines through the ceiling of the vehicle.

25 Claims, 8 Drawing Figures

Figure 1:
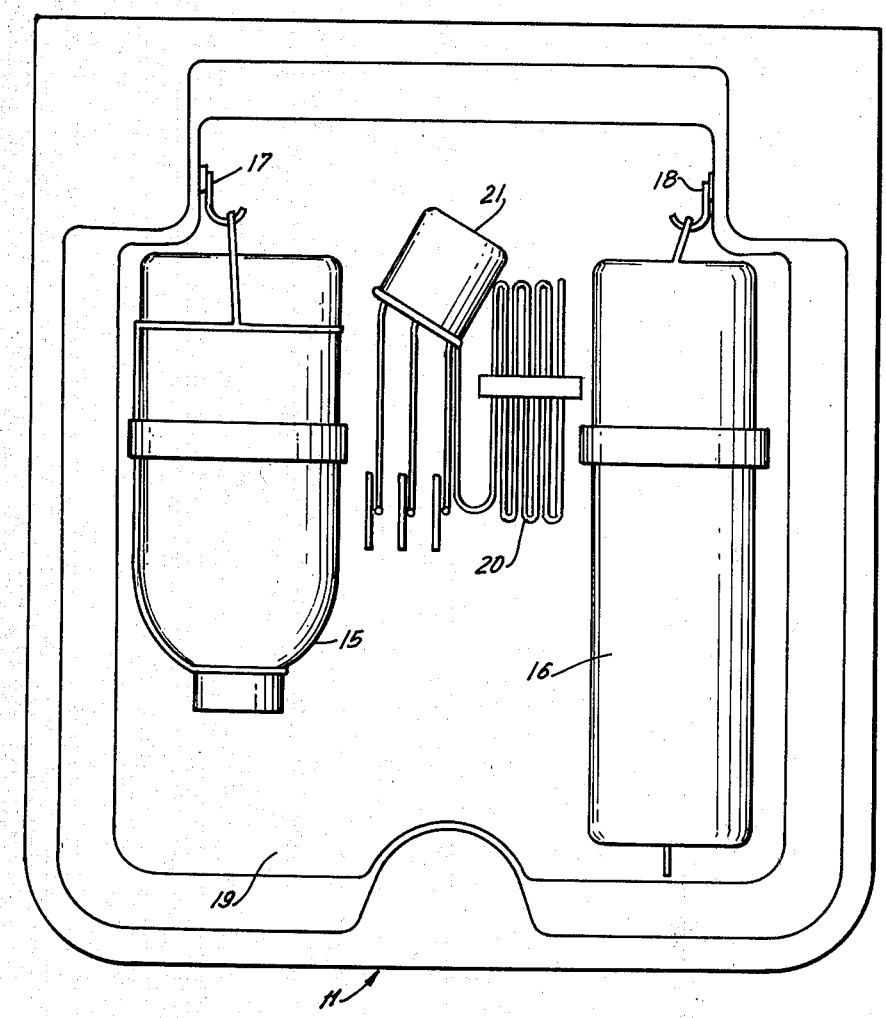

FIG. 7
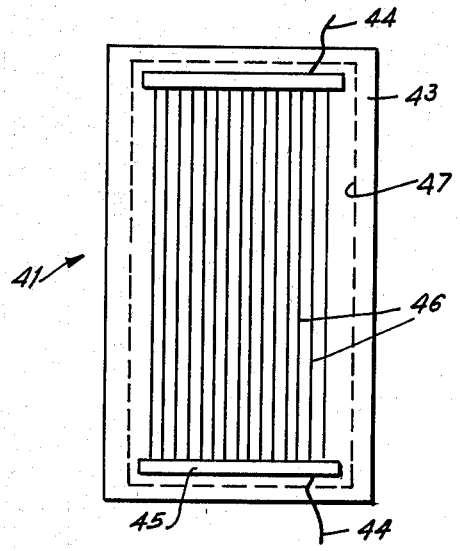
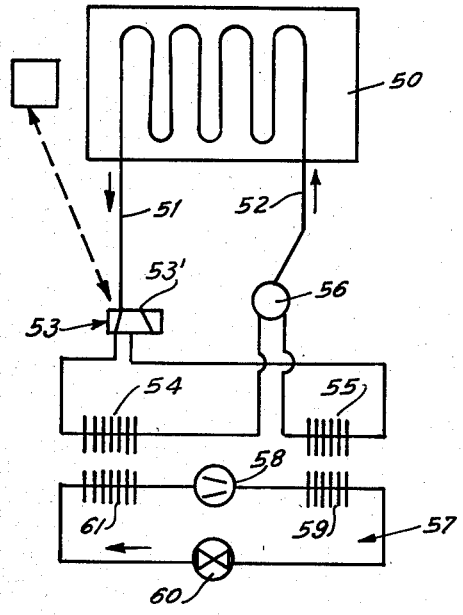
FIG. 8

COACHWORK FOR A MEDICALLY EQUIPPED VEHICLE

FIELD OF THE INVENTION

The invention relates to coachwork for a medically equipped ambulance or similar vehicle having a cabin for accommodating medical apparatus such as infusion flasks, respirators and the like received in devices pivotably fastened to the ceiling or an associated part of the cabin.

BACKGROUND TO THE INVENTION

In ambulances and first aid vehicles precious time is often unnecessarily wasted in collecting together, preparing and connecting the apparatus that is required for use at any one time. For example, when giving an infusion, the infusion flask or bag and the infusion apparatus such as the needle must be collected together from different locations within the vehicle. The hanging up of the flask and the connection of the infusion equipment take up further time so that valuable seconds are lost.

A similar case arises when giving oxygen as the equipment that is needed is not always as readily to hand as it could be. Thus decisive seconds can also be lost in preparing to supply a patient with oxygen. The same applies to the connection of electro-cardiograph electrodes. Moreover this period of delay often gives rise to unrest and to a hectic situation in the vehicle which causes additional difficulties for the personnel trying to get past one another within the narrow confines of the vehicle. Cables and hoses for the supply of oxygen frequently hang and lie across one another and are an additional hinderance.

The principal object underlying the invention is to provide coachwork for a medically equipped vehicle in which the apparatus is readily accessible without restricting the room available for movement of the operating personnel.

BRIEF DESCRIPTION OF THE INVENTION

The above object is accomplished by the provision of coachwork for a medically equipped vehicle having a cabin for accommodating medical apparatus such as infusion flasks, respirators and the like and means pivotally fastened to a ceiling or associated part of said cabin for receiving said medical apparatus, wherein said means comprises at least one container in which said medical apparatus is protectedly housed with said at least one container being pivotable downwardly from a first position, in which it lies adjacent said ceiling, to a second position in which said medical apparatus is freely accessible from within said cabin.

Thus, in accordance with the invention, otherwise unused space above a treatment table inside the medically equipped vehicle can be provided for medical apparatus and also infusion flasks so that the apparatus and infusion flasks can be maintained centrally in a region in the immediate vicinity of the patient ready for use in an emergency.

If substances which are to be infused are already present in one of the containers it is necessary for these substances to have a temperature of at least 20° C. during the infusion in order to avoid damage to the health of the patient, in particular conditions of shock. The emergency patient, as a rule, in any case needs additional warmth and infusions that are too cold can place a considerable additional burden on such a patient.

A certain increase in the temperature of the solution to be infused does not harm the patient, the life of the solution is, however, in general reduced. Accordingly the temperature should not exceed 35° C.

A temperature range of from 25° C. to 35° C. can be regarded as an optimum. To maintain this temperature range it is useful if a thermostatically control heating device is arranged in the container. A thermostatically controlled heating device will prevent an impermissible cooling of the infusion and thus also long warming up times which would otherwise be necessary because infusions can only be heated by the careful, i.e. moderate supply of heat.

In temperate climatic zones no excessive heating of the inner space of the container need be feared even on hot days. However, in order to prevent overheating of the solutions to be infused even in tropical climates a thermostatically controlled heat exchanger can be arranged in the space enclosed by the container with the thermostatically controlled heat exchanger being connectable to an air conditioning system or refrigerating system within the vehicle in order to cool this space.

This heat exchanger is preferably selectively connectable with the evaporator or condensor of the air conditioning or refrigeration plant via conduits for the flow of a heat transporting medium. The heat exchanger primarily serves to cool the space within the container and secondarily for warming this space. Blood plasma and infusion solutions are thus protected both against overcooling and overheating.

When the possibility of cooling the blood plasma and infusion solutions is not required, such as in temperate climatic zones, i.e. when only a drop in temperature needs to be prevented, the required heating of the container can, in particular, take the form of electrical resistive heating. For this purpose the heating device can be provided with one or more resistive heating conductors which can be attached to an insulating layer such as a plastic foil. The conductors are preferably protected against damage by a cover which can likewise be of plastic. The resistive heating conductors can be produced by methods which are known from the manufacture of printed electric circuits such as screen printing processes.

In order to keep the heating power, and if required also the necessary cooling power, as low as possible it is advantageous if the walls of the container and the region of the ceiling which covers the container in the first raised position, and also parts connected thereto, are of heat insulating construction. For this purpose the walls of the container and the cabin ceiling, or at least the part of the ceiling above the container, can have a heat insulating coating for example of solid synthetic foam which simultaneously acts as a cushion and protects the personnel of the vehicle from injury. If desired the container can also consist, at least in part, of a heat insulating hard foam such as a conventional foamed resin.

BRIEF DESCRIPTION OF THE ACCOMPANYING DRAWINGS

Figure 3:
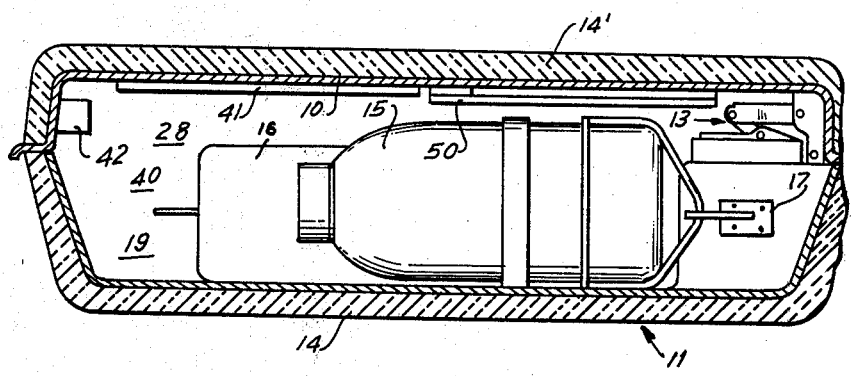
Figure 2:
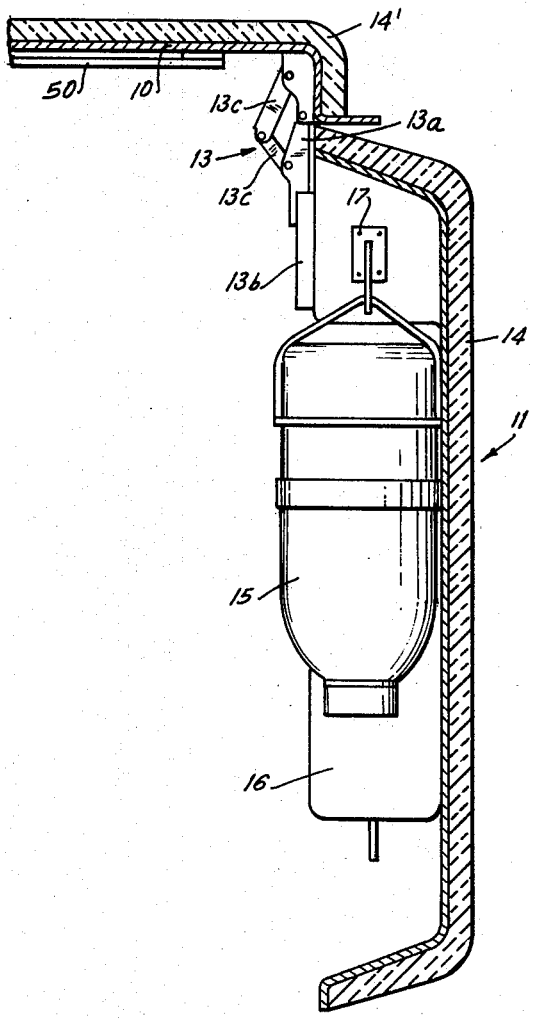
Figure 4:
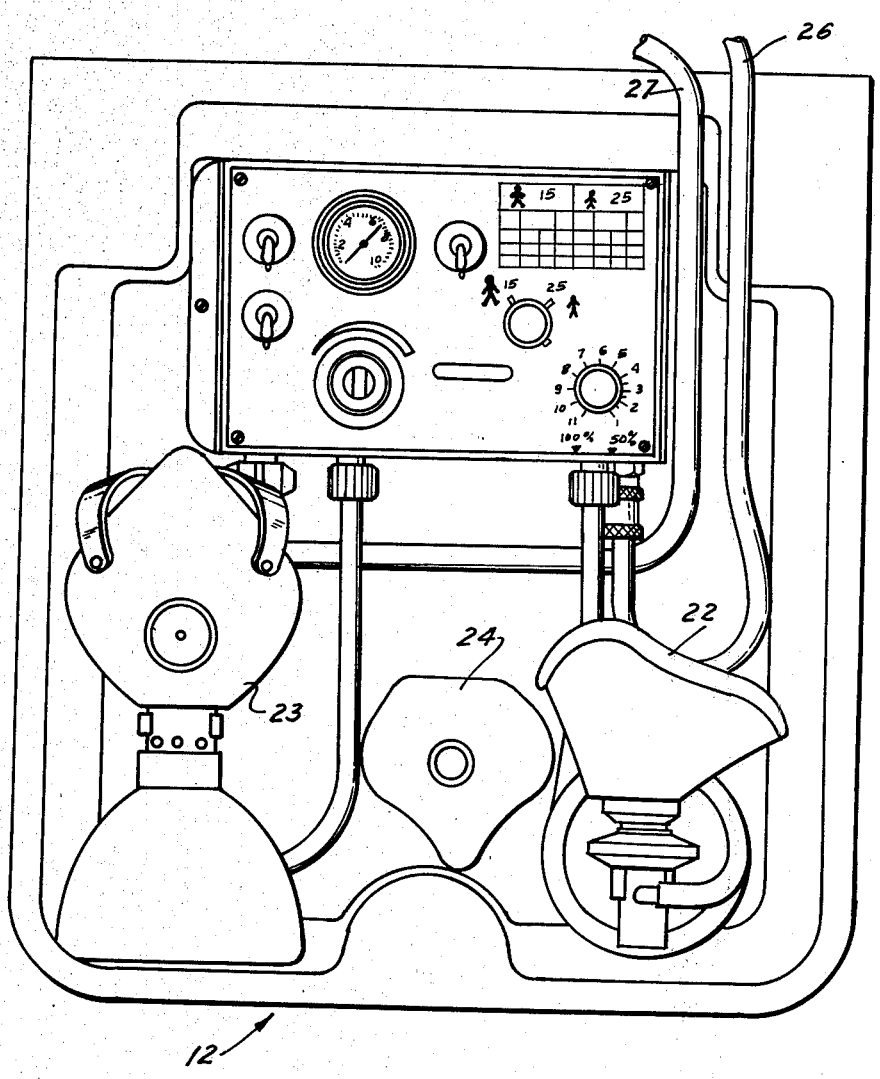
Figure 5:
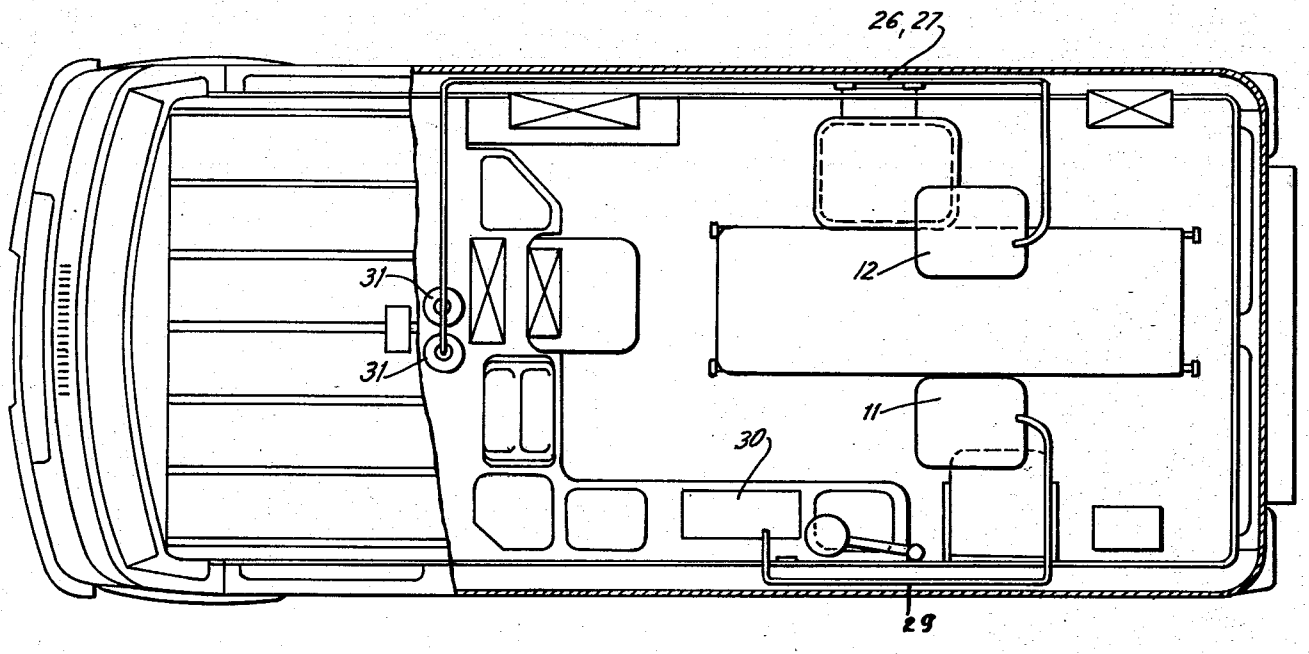
Figure 6:
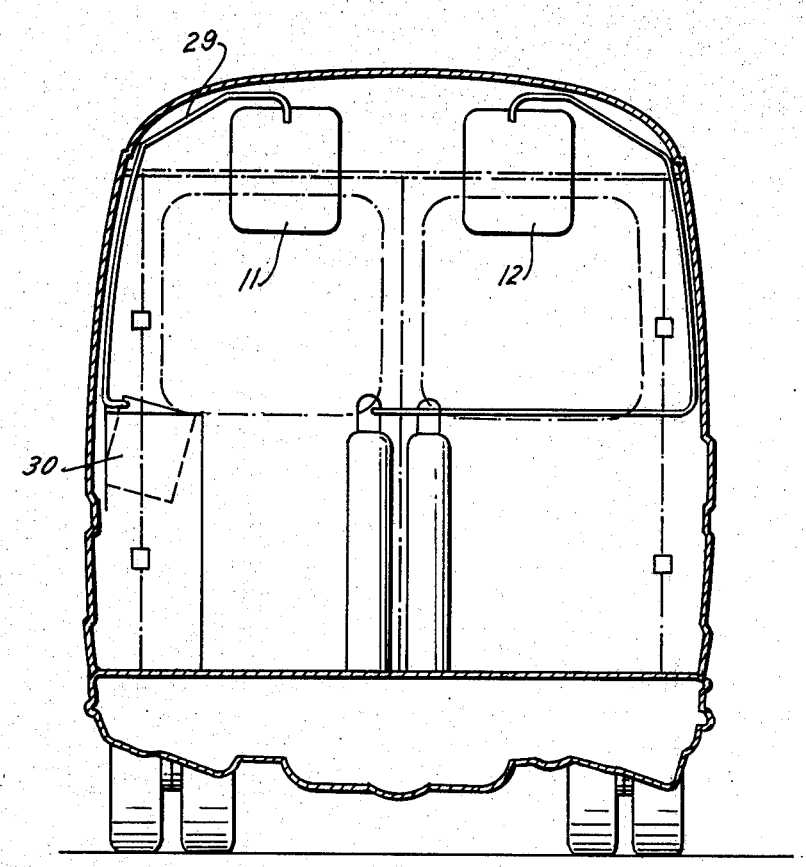

Embodiments of the invention will now be explained in the following by way of example only and with reference to the accompanying figures which show:

FIG. 1 a plan view of a container equipped with infusion apparatus in accordance with the present teaching, FIG. 2 a section through the container with the container in a hanging position, FIG. 3 the same section as in FIG. 2 however showing the container in a raised position against a ceiling of a vehicle, FIG. 4 a plan view of a container holding respiratory apparatus and in accordance with the present teaching, FIG. 5 a lay-out in plan view of coachwork for a vehicle equipped in accordance with the present teaching, FIG. 6 a section through the coachwork of FIG. 5, FIG. 7 a plan view of an electrical resistive heating device for a container of the type illustrated in FIGS. 2 and 3 and FIG. 8 a circuit diagram showing the cooperation between a heat exchanger, suitable both for cooling and also for heating, with a heat pump.

Referring firstly to FIG. 6 one or two containers 11 and 12 are illustrated mounted on the ceiling 10 of the inner cabin of a medically equipped vehicle. The detail of this mounting can also be seen by referred to FIGS. 2 and 3 from which it is apparent that each of the containers is secured by a hinge device 13 which allows it to be pivoted downwardly from a first position in which it lies closely adjacent the ceiling of the vehicle to a second hanging position in the space below the ceiling.

The hinge device 13 is preferably a sliding hinge arrangement or a pair of such sliding hinges and is usefully positioned inside a recess 28 of the vehicle ceiling 10 which is open at its lower side and which is closed by the respective container 11 or 12 which acts as a kind of lid. In detail the hinge device comprises a slider 13*a* which is pivotally connected to the ceiling 10 and which is slidably guided in a guide 13*b* on the container 11 (or 12). The pivotal movements of the slide 13*a* are damped by an appropriately constructed pair of links 13*c*. This damping can for example be effected by means of a frictional damper incorporated between the two links 13*c* or by means of appropriate springs or hydraulic dampers. The pivot arrangement can also include latching devices as known per se so that the containers can be latched in desired end positions in particular in the hanging second position.

It will be appreciated that the specific arrangement of the hinge 13 as illustrated in form of a four bar linkage with four pivot points and the provision of the relative sliding possibility prevents the rear edge of the container from fouling on the ceiling during downward pivotal movement of the same and also enables the container to be slid in a direction parallel to the ceiling so that the container can be readily aligned with the ceiling in the first, raised, position of FIG. 3. It will be appreciated that the container can be clipped into this position either by way of a clip provided at the side of the container remote from the hinge (for example a toggle clip) or by suitable design of the hinge 13 to be self-locking in the upper, first position of the container.

The containers 11 and 12 are of trough-like construction so that their inner spaces 19 cooperate with the respective open recesses 28 in the first raised position of the containers to jointly form spaces 40 which are sufficient for the accommodation and attachment of the relevant medical apparatus. The chamber 19 within the trough is preferably larger than the chamber within the recess 28. Leather, or rubber, straps or the like can be provided to additionally secure the apparatus within the containers 11 and 12. The containers 11 and 12 of trough-like construction can have an external foamed and/or upholstered layer 14 in order to avoid damage to the containers or injury to personnel.

The layer 14 can simultaneously serve, together with a corresponding layer 14' which is arranged on the recess 28, to thermally insulate the space 40.

In the container 11 which is illustrated in FIGS. 1 to 3 there are mounted a ready connected flask of blood plasma 15 and on the hook 17 an infusion bag 16 together with the apparatus for giving the infusion, i.e. the needle and tube which is already connected to the infusion bag but is, however, not illustrated.

In order to maintain the temperature inside the space 40 above 20° C. and preferably above 25° C. there is provided an electrical heating device 41 which is fed from the on board power supply of the vehicle and is switched in and switched out by means of a thermostat 42 which can for example be a thermostatically controlled switch. This switch is able to switch on the heating when the temperature in room 40 drops below 27° C. and to switch it off again when a value of 30° C. is exceeded.

The heating device 41 is preferably arranged, as illustrated, within the recess 28 so that no movable electrical cables are required. If necessary a corresponding heating device can be arranged as an alternative, or additionally, on the inner side of the container 11. The same applies to the thermostat 42.

The electrical heater 41 can be constructed in accordance with the arrangement shown in FIG. 7. In this arrangement conductive strips 45 which are each provided with connection cables 44 are arranged spaced apart from one another on a heat resistant electrically insulating foil or film 43. The conductive strips 45 are connected together by resistive heating conductor 46 which are likewise arranged on the foil 43. The conductive strips 45 and also the resistive heating conductors 46 are protected against damage by a cover 47 which can consist of a further heat resistant foil adhered to the foil 43. A heating device of this kind can be straightforwardly glue to the inner side of the recess 28.

In order to be able to cool the space 40 is required, a heat exchanger 50 can likewise be arranged inside the recess 28, this is the preferred arrangement. The heat exchanger 50 is connectable, by way of a signal generated from the thermostat 42 when the temperature rises above approximately 33° C., to a refrigeration or air conditioning plant of the vehicle in order to cool the space 40. As soon as the temperature in the space 40 falls below a temperature of, for example, 30° C. the heat exchanger 50 is once more decoupled from the refrigeration or air conditioning plant.

If required the heat exchanger 50 can be used both for heating the space 19 and also for cooling the same in the manner explained with reference to FIG. 8. In the arrangement of FIG. 8 the heat exchanger 50 is selectively connectable, via conduits 51, 52 which carry a heat transfer medium and a valve 53 controlled by the thermostat 42, to either a heat transfer device 54 or a heat transfer device 55. In the illustrated position of the valve 53 the heat transfer medium is forwarded by means of a pump 56 from the heat transfer device 54 to the heat exchanger 50 and from there back to the heat transfer device 54.

If the slider 53' of the valve 53 is displaced to its left hand position as a result of a corresponding command of the thermostat 42 then the heat transfer medium circulates between the heat exchanger 50 and the heat transfer device 55.

A refrigeration or air conditioning plant of the vehicle includes a heat pump 57 in which a heat pump medium is compressed in known manner by means of a compressor 58 and is then passed through a condenser 59 and subsequently expanded through a reducing valve 60 from which it passes, with reduced pressure and correspondingly reduced temperature, to an evaporator 61 from where it is once more picked up by the compressor 58. The condensor 59 has a temperature which is increased relative to the ambient temperature and the evaporator 61 a temperature which is reduced relative to the ambient temperature. As a result of the heat conducting association of the evaporator 61 with the heat transfer device 54 the latter can be correspondingly cooled. In a similar way the heat transfer device 55 can be warmed as a result of its heat conducting association with the condensor 59. Thus, depending on the direction in which the valve 53 is switched the heat exchanger 50 can be held at a temperature which lies either below the environmental temperature or above the environmental temperature respectively. Cooling or heating of the space 40 is thus possible by means of the heat exchanger 50. As long as the space 40 has a temperature within the desired range the slider 53' of the valve 53 can adopt an intermediate position and the pump 56 can be switched off so that the heat exchanger 50 is decoupled from the heat pump 57 and produces neither heating nor cooling of the space 40.

The container 12 contains, as shown in FIG. 4, a respirator 22, a respirator 23 with a breathing bag, a childs respirator 24 and an automatic respiration machine 25 (for example a "Medumat unit" (registered trademark). The supply of oxygen takes place via a hose-like line 26 which leads to the automatic respirator 25 and passes through openings in the ceiling of the vehicle, or behind the internal trim of the vehicle, and emerges from the ceiling inside the downwardly pivotable container. The flask which supplies the oxygen is housed at some other suitable location in the vehicle. The hose-like line 27 allows the oxygen to be drawn off from the oxygen flask through the automatic respirator 25.

When not in use the containers 11 or 12 are folded up against the ceiling 10 and thereby do not hinder, or at most only trivially hinder, the doctor or medical officer.

When the containers are pivoted downwardly the apparatus that they accommodate is at once fully accessible to the doctor providing the treatment.

The containers are preferably accommodated in the vehicle, for example an ambulance, on both sides of a holding rail provided therein. If required, when using only one of the containers the holding rail can be interrupted at the location of the container. The pivot mounts for the containers are advantageously located at the rear sides thereof so that in the downwardly pivoted position the inbuilt apparatus can be used from in front of the container, i.e. from the seat occupied by the medical officer.

The distribution of the apparatus on the containers can obviously be arranged differently to the extent that this is desired or useful.

FIGS. 5 and 6 show one arrangement, by way of example, of the containers 11 and 12 on the ceiling of the vehicle. In FIG. 6 it is assumed that the containers have been pivoted downwardly to the aforementioned second positions. A cable leading from the electro-cardiograph apparatus 30 to the electrode 21 is indicated by the reference numeral 29. 31 are oxygen flasks for charging the hose-like conduit 26.

Each container is preferably provided with a hand grip.

It will be appreciated by those skilled in the art that other modifications can be made to the above described arrangements without departing from the scope of the present teaching.

I claim:

1. Coachwork for a medically equipped vehicle including a cabin for accommodating medical apparatus for emergency cases and means for receiving said medical apparatus, said means being pivotally arranged between a first upward position in which it lies adjacent a ceiling or associated part of said cabin and is fastened thereto, and a second downward position in which the means is freely accessible from within the cabin, said means comprising at least one container protectedly housing said medical apparatus and accommodating at least one infusion flask or bag and infusion instruments.

2. Coackwork for a medically equipped vehicle including a cabin for accommodating medical apparatus for emergency cases and means for receiving said medical apparatus, said means being pivotally arranged between a first upward position in which it lies adjacent a ceiling or associated part of said cabin and is fastened thereto, and a second downward position in which the means is freely accessible from within the cabin, said means comprising at least one container protectedly housing said medical apparatus and accommodating at least one respirator with respirator masks and accessories.

3. Coackwork for a medically equipped vehicle in accordance with claim 1 or 2, in which said vehicle comprises an ambulance.

4. Coachwork for a medically equipped vehicle in accordance with claim 1 or 2, wherein said at least one container is of trough-like construction such that the medical apparatus lies wholly or substantially within a trough-like chamber of the container.

5. Coachwork for a medically equipped vehicle in accordance with claim 1 or 2, wherein cables, hoses and the like that are necessary for the medical apparatus are led to the apparatus in said at least one container through the ceiling of said cabin.

6. Coackwork for a medically equipped vehicle in accordance with claim 5, wherein said ceiling is of double-wall construction.

7. Coackwork for a medically equipped vehicle in accordance with claim 1 or 2, wherein said at least one container is provided with a cushioned layer on its outer side.

8. Coachwork for a medically equipped vehicle in accordance with claim 1 or 2, wherein said least one container is provided with a foamed layer on its outer side.

9. Coackwork for a medically equipped vehicle in accordance with claim 1 or 2, wherein a hinge device is provided for pivotally fastening said at least one container to said ceiling or associated part, said hinge device incorporating a slide arrangement with a slider mounted for restricted sliding displacement in a guide part fastened to said at least one container so that the container, on being pivoted upwardly from said second position to said first position adjacent the ceiling can execute a displacement with respect to the ceiling in a direction approximately parallel thereto.

10. Coachwork for a medically equipped vehicle in accordance with claim 4, wherein a recess is provided in the ceiling of said cabin which cooperates with the trough-like chamber of said container to jointly form a chamber for the accommodation and attachment of the medical apparatus arranged in said container.

11. Coachwork for a medically equipped vehicle in accordance with claim 10, wherein the depth of the trough-like container is greater than the depth of the recess in the ceiling of said cabin.

12. Coachwork for a medically equipped vehicle in accordance with claim 1, wherein at least two containers are provided within said cabin of which one container is said at least one container and the second container accommodates at least one respirator with respirator masks and accessories.

13. Coachwork for a medically equipped vehicle in accordance with claim 1 or 12, wherein a thermostat controlled heating device for keeping the infusion flask warm is arranged within a space confined by said at least one container in said first position.

14. Coachwork for a medically equipped vehicle in accordance with claim 13, wherein said thermostatically controlled heating device comprises an electrical heating device.

15. Coachwork for a medically equipped vehicle in accordance with claim 13, wherein said thermostatically controlled heating device comprises a heat exchanger.

16. Coachwork for a medically equipped vehicle in accordance with claim 13, in which said thermostatically controlled heating device comprises a thermostatically controlled heat exchanger connectable to an air conditioning or refrigeration plant in the vehicle whereby to cool the said space.

17. Coachwork for a medically equipped vehicle in accordance with claim 16, wherein said refrigeration plant comprises a heat pump.

18. Coachwork for a medically equipped vehicle in accordance with claim 16, wherein said heat exchanger is selectively connectable with an evaporator or a condensor of the air conditioning plant via conduits carrying a heat transporting medium.

19. Coachwork for a medically equipped vehicle in accordance with claim 13, wherein said thermostatically controlled heating device comprises an electrical resistive heating device.

20. Coachwork for a medically equipped vehicle in accordance with claim 19, wherein said electrical resistive heating device includes resistive heating conductors arranged on an electrically insulating layer there being further provided a covering to protect said conductors against mechanical damage.

21. Coachwork for a medically equipped vehicle in accordance with claim 20, wherein said electrically insulating layer comprises an insulating foil.

22. Coachwork for a medically equipped vehicle in accordance with claim 13, wherein the walls of said at least one container and that part of the container and that part of the ceiling cooperating with the container to define said space are provided with thermal insulation.

23. Coachwork for a medically equipped vehicle in accordance with claim 22, wherein said thermal insulation comprises a heat insulating coating.

24. Coachwork for a medically equipped vehicle in accordance with claim 22, wherein said thermal insulation comprises a synthetic foam.

25. Coachwork for a medically equipped vehicle in accordance with claim 1 or 13 wherein said at least one container consists at least in part of a thermal insulating hard foam.

* * * * *